US006793165B2

(12) United States Patent
Obitz

(10) Patent No.: US 6,793,165 B2
(45) Date of Patent: Sep. 21, 2004

(54) APPARATUS AND METHOD FOR TREATING MILLING PRODUCTS

(76) Inventor: Lars Obitz, Isterberget 3, Vaxholm (SE), SE-185 00

( * ) Notice: Subject to any disclaimer, the term of this patent is extended or adjusted under 35 U.S.C. 154(b) by 84 days.

(21) Appl. No.: 10/220,240

(22) PCT Filed: Feb. 13, 2001

(86) PCT No.: PCT/SE01/00287

§ 371 (c)(1),
(2), (4) Date: Aug. 30, 2002

(87) PCT Pub. No.: WO01/66853

PCT Pub. Date: Sep. 13, 2001

(65) Prior Publication Data

US 2003/0019962 A1 Jan. 30, 2003

(30) Foreign Application Priority Data

Mar. 7, 2000 (SE) ..... 0000752

(51) Int. Cl.[7] ..... B02C 7/00
(52) U.S. Cl. ..... 241/28; 241/245
(58) Field of Search ..... 241/23, 28, 261.2, 241/261.3, 30, 79, 244, 245, 241

(56) References Cited

U.S. PATENT DOCUMENTS 5,148,998 A 9/1992 Obitz

FOREIGN PATENT DOCUMENTS

SE 510247 5/1999

*Primary Examiner*—Mark Rosenbaum
(74) *Attorney, Agent, or Firm*—Dowell & Dowell, P.C.

(57) ABSTRACT

An apparatus for treating milling products comprises a housing (1), a rotor (2) rotatably arranged in said housing (1) and having at least one pocket (8) for receiving steam-containing milling products which is to the processed, an inlet (6) in the housing (1) for steam-containing milling products for passing on to the pocket (8) and an outlet (12) in the housing (1) for milling products to a steam proof discharge device, said pocket (8) being at least partly open radially outwards, and an outlet in the housing (1) for steam. The rotor pocket (8) is provided with a radially inwards facing opening for steam (14), which can be connected with a steam outlet (15, 16, 17, 18) of the housing (1) at least once per revolution during the rotation of the rotor (2). The invention also relates to a method for treating milling products.

11 Claims, 2 Drawing Sheets

APPARATUS AND METHOD FOR TREATING MILLING PRODUCTS

BACKGROUND OF THE INVENTION

1. Field of the Invention

The present invention relates to a device for treating milling products, comprising a housing, a rotor rotably mounted inside the housing and the rotor including at least one pocket for reception of steam-containing milling products, which is to be treated, an inlet in the housing for steam-containing milling products to be passed on to the pocket and an outlet in the housing for milling products to a steam proof discharge device, the pocket being a provided with a radially outwards facing opening, and a steam outlet in the housing. The present invention does also relate to a method for treating milling products according to which steam-containing milling products is fed via a housing to a pocket in a rotor rotating in the housing, the milling products is, under influence of the centrifugal force, moved radially outwards towards the circumferential surface of the housing and then thrown out through an outlet for milling products when the pocket has been brought in communication therewith.

2. Description of the Related Art

When lignocellulose containing products are milled, for example defibration of woodchips to pulp, where large amounts of energy are supplied to the milling apparatus or the defibrator, large amounts of steam are generated. The energy content of the steam is considerable and must be taken care of in order to improve the economy of the plants for pulp production. Generally, the steam is separated from the pulp after the defibration in so called cyclones which operate with centrifugal separation. However, in these devices clogging problems often arise due to the fact that the moist pulp deposits on the walls and tubes of the cyclone forming lumps which grow and eventually the separation comes to an end, so that the production has to be stopped and the separator must be cleaned.

It is usual, in order further to process the pulp, after the defibrator to include a milling machine, refiner, by which the pulp is finely ground before being supplied to the steam separator cyclone.

These problems are, according to the Swedish patent SE 510 247 C2, solved with a device for treating milling products. That device comprises a housing in which there is rotatably arranged a rotor having a number of pockets which in turns are in communication with an inlet for milling products. The milling products are thrown out by a centrifugal force through a radially outwards facing opening in the pockets and further to a milling products outlet in the housing when the pocket and the milling product outlet are in communication with each other. The steam is then blown out from the pocket into a steam outlet in the housing when they are in communication. The inlet and the steam outlet are arranged parallel to the rotor shaft. The inlet, the milling products outlet and the steam outlet are angularly displaced in relation to each other.

SUMMARY OF THE INVENTION

The purpose of the present invention is to provide a device which cleans the steam from milling products particles to a higher extent then what take place in the prior art.

That object is attained with a device for treating milling products according to the introductory paragraph which is characterized in that the rotor pocket is provided with a radially inwards facing opening for steam which can be put in communication with the outlet for steam, at least once for every revolution during the rotation of the rotor. A method according to the introductory paragraph is characterized by the fact that the remaining steam is thereupon emptied radially inwards when the pocket is brought into communication with the steam outlet of the housing.

An advantage of this device is that it cleans the steam effectively since remaining particles would have to move against the action of the centrifugal force in order to leave with the outgoing steam, which consequently does not occur.

According to one embodiment the outlet for steam includes a projection provided with at least one channel or a space and at least one radially outwards facing opening, said projection extending a distance in the central area of the rotor so that the opening of the projection can be brought into communication with at least one of the radially inwards facing openings of the rotor pockets.

This brings the advantage that the radially inwards facing openings of the rotor pockets are sealed by the projection, except when they coincide with the opening of the projection.

The inlet for steam-containing milling products, the outlet for milling products and the outlet for steam are angularly displaced in relation to each other.

The inlet for steam-containing milling products is preferably oriented substantially axially in relation to the rotor in a flange of the housing but can of course be arranged in another way, for example tangentially.

The rotor pocket can have a through passage, in which case the rotor pocket is sealed off at the housing flanges or the rotor exhibit a wall on the one side of the rotor pocket, in which case the rotor pocket is sealed against a flange of the housing. In addition thereto, the outer circumference of the rotor is preferably sealed relatively the housing.

The rotor can be provided with an arbitrary number of rotor pockets, but suitably with at least five rotor pockets and preferably eight rotor pockets.

BRIEF DESCRIPTION OF THE DRAWINGS

The invention will be described below with reference to the annexed diagrammatic drawings which for purposes of exemplifying illustrate a presently preferred embodiment of the invention.

DETAILED DESCRIPTION OF A PREFERRED EMBODIMENT

Figure 2:
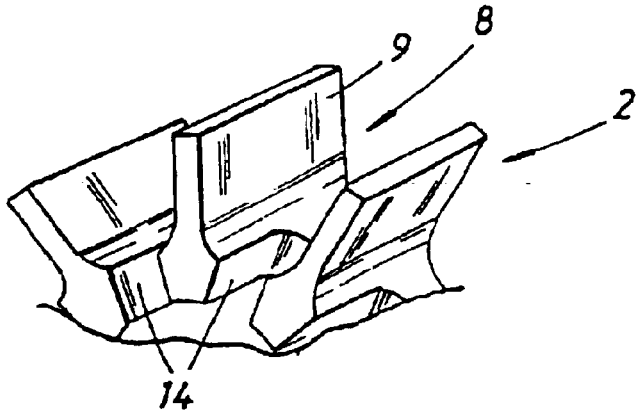
FIG. 2 is a perspective view showing a portion of a rotor which is comprised in the device according to the invention.

The device for treating milling products shown in the figures comprises a housing 1 and a rotor 2 which is rotatebly arranged in the housing 1. The housing 1 is in turn supported by a framework 4. The rotor 2 is driven by a rotor shaft 5 by a drive motor (not shown) in a direction indicated by an arrow in FIG. 3. In the first end flange 7 of the housing 1 an inlet 6 for milling products containing steam is provided, to which milling products containing steam is supplied by steam from a preceeding processing step, such as a defibrator (not shown). The inlet 6 is located in the housing substantially parallel to the rotor shaft 5 at a radial distance from the centre of rotation corresponding to the radial distance where pockets 8 are located in the rotor 2. In the shown case there are eight pockets 8 but their number can naturally be varied as suitable. The milling products containing steam is conducted into a pocket 8 in the rotor 2, whereupon the next pocket is filled and so on, during the rotation of the rotor 2. The pockets 8 can be axially open, at least towards the inlet 6, with just one partitian 9 between themselves, as is shown in FIG. 2, or they can have a lateral wall facing a second flange 10 in the housing 1. Sealing rings 11 can be provided between the rotor 2 and the housing 1.

The pockets 8 are open radially outwards or have openings emerging radially inwards. The pocket 8, filled with steam-containing milling products, is brought during the rotation of the rotor 2 from the inlet to coincide with a corresponding opening in the housing 1 and an outlet 12 for milling products. The centrifugal force transports the milling products in the pocket 8 radially outwards towards the circumference 13 of the housing 1, so that the milling products and the steam are separated, i.e. the steam is cleaned from milling products which passes out through the outlet 12 when the pocket 8 and outlet 12 are brought into communication. The outlet 12 leads to a steam proof discharge device for the milling products, such as a plug screw (not shown), which transports the milling products further while forming a steam proof pulp plug, which is prior art in this art.

Figure 1:
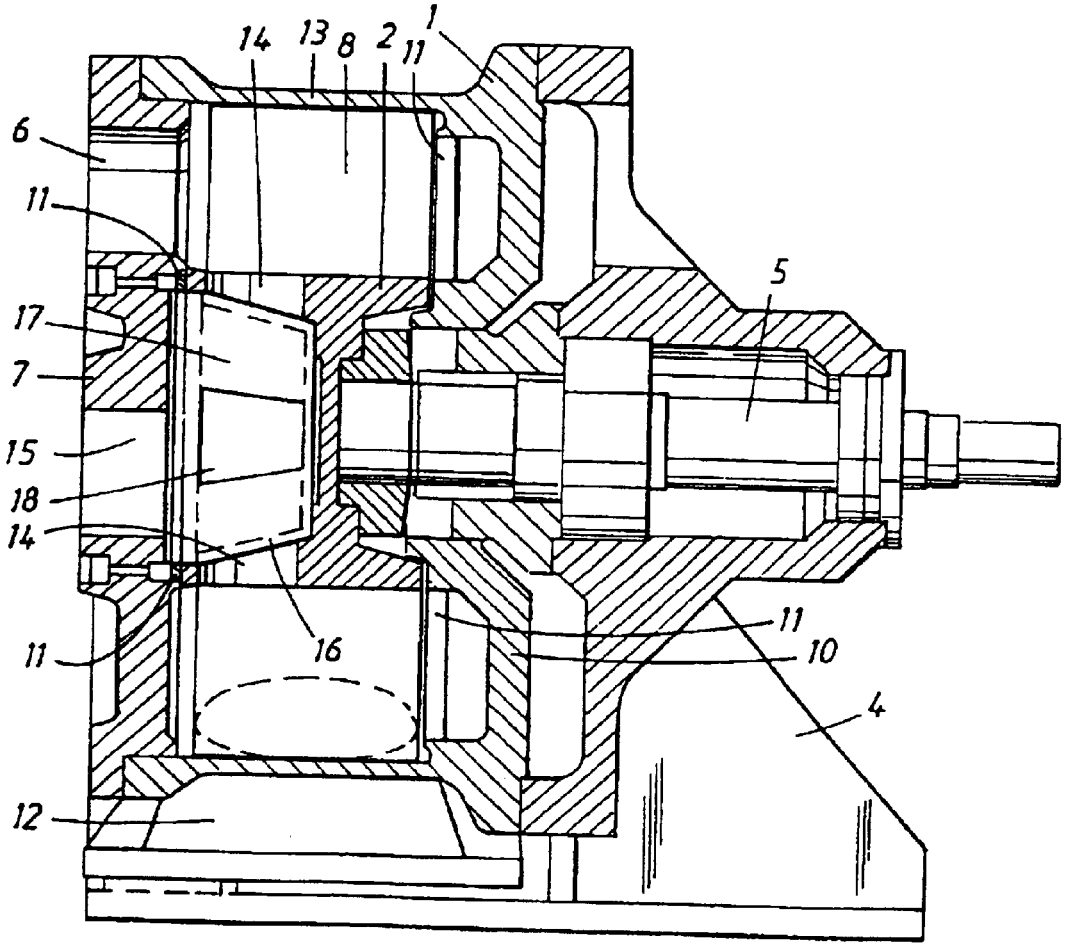
FIG. 1 is a cross-sectional view through a device for processing milling products according to the present invention, taken along its rotor shaft.
Figure 3:
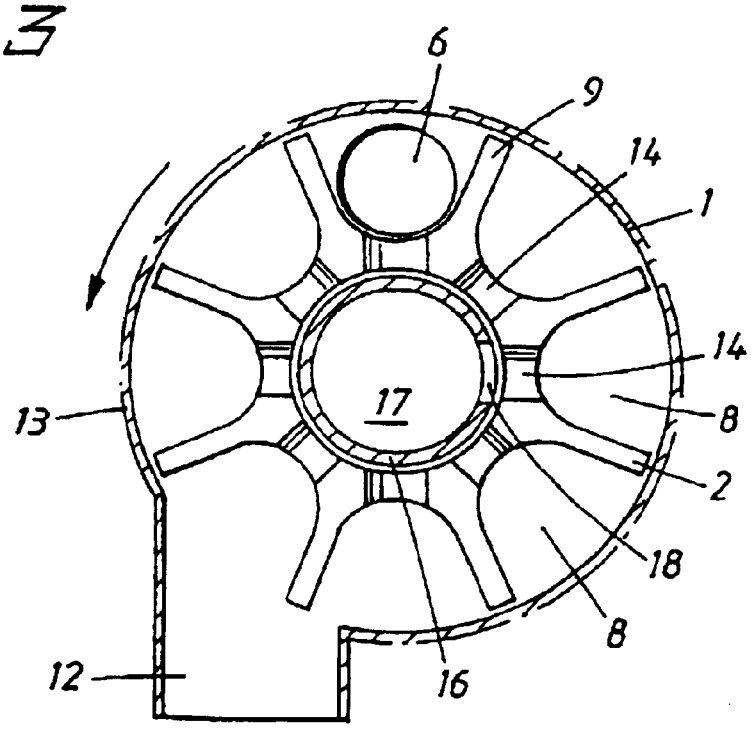
FIG. 3 is a diagrammatic drawing showing the position of the rotor in the device according to the invention.

Each pocket 8 is at its bottom provided with a radially inwards facing opening 14, the size of which, in the shown case, corresponds to about half of the bottom area, see FIGS. 2 and 3. When the milling products have been thrown out through the outlet 12 for milling products the remaining steam, which can not disappear out through the steam proof discharge device, is conducted, during the rotation of the rotor 2 until the radially inwards facing opening 14 of the pocket 8 coincides with an opening 18, to an outlet for steam in the housing 1. The opening 18 should have such a size that it corresponds to one opening 14 of a rooter pocket, can be larger, for example cover two subsequent rotor pocket openings 14 (not shown). The steam which was integrated in the milling products and which supplied the milling products to the housing 1, and any steam formed during the processing of the milling products in the housing 1 blow out through the steam outlet, whereupon the energy content of the steam is taken care of in some known manner, The outlet for steam includes a portion projecting from the housing 1, such as a drum or casing 16 which protrudes a distance into the centre of the rotor 2, i.e. preferably equally far as the extension of the openings 14 of the pockets 8. According to the shown example, see FIG. 1, the drum 16 protrudes about midway into the centre of the rotor 2. The drum 16 preferably has the shape of a conically tapering cylinder with walls and a bottom sealing against the rotor 2 and the housing 1 except at the opening 18 and the opening at the outlet in the housing 1. A channel or a cavity 17 is formed inside the drum 16 which is in communication with the opening 18 emerging radially outwards towards the rotor. Alternatively several openings 16 can be located in the drum 16 (not shown). The drum 16 can preferably be turned so that the user can select a suitable position for the opening 18. Accordingly, the drum 16 seals off the inwardly facing openings 14 of the rotor pockets 8 except at the opening 18. To the side of drum 16 that open towards the end flange 7 of the housing 1 the outlet channel 15 is provided in flange 7, which channel 15 transports the steam onwards for continued use, as described above.

The inlet for steam-containing milling products 6, the outlet for milling products 12 and the outlet 15 for steam are angularly displaced in relation to each other. They are also preferably located in that succession with reference to the rotational direction of the rotor 2, see FIG. 3.

What is claimed is:

1. An apparatus for treatment of milling products, comprising a housing (1), a rotor (2) rotably mounted in said housing (1) and comprising at least one pocket (8) for reception of steam-containing milling products which are to be treated, an inlet (6) in the housing (1) for steam-containing milling products to be passed on to the at least one pocket (8), and an outlet (12) in the housing (1) for milling products to a steam proof discharge device, the at least one pocket (8) being at least partially open radially outwardly, and a steam outlet in the housing (1), wherein the at least one rotor pocket (8) is provided with at least one radially inwardly facing opening (14) for steam, which is arranged to be in communication with steam outlet (15, 18) of the housing (1) at least once per revolution during rotation of the rotor (2).

2. An apparatus according to claim 1, wherein the outlet for steam in the housing (1) further comprises a drum (16) which is provided with at least one channel (17) and at least one radially outwardly facing opening (18), said drum (16) projects a distance into a central area of the rotor (2) so that the at least one outwardly facing opening (18) of drum (16) can be in communication with at least one of the radially inwardly facing openings (14) of the at least one pocket (8).

3. An apparatus according to claim 2, wherein the inlet (6) for steam-containing milling products, the outlet (12) for milling products and the outlet (18) for steam are angularly displaced relatively to each other.

4. An apparatus according to claim 3, wherein the inlet (6) for steam-containing milling products is substantially axially located in relation to the rotor (2) in an end flange of the housing (1).

5. An apparatus according to claim 4, wherein the inlet (6) for steam-containing milling products is located at a corresponding radial distance as the at least one rotor pocket (8).

6. An apparatus according to claim 1, wherein the at least one rotor pocket (8) is through going, being sealed off against end flanges (7,10) in the housing (1).

7. An apparatus according to claim 1, wherein the rotor (2) includes a wall at one side of the at least one rotor pocket (8), and the at least one rotor pocket (8) being sealed off against an end flange (7) in the housing (1).

8. An apparatus according to claim 1, wherein the rotor comprises at least five rotor pockets (8).

9. An apparatus according to claim 8 wherein the rotor includes eight rotor pockets (8).

10. An apparatus according to claim 1, wherein the outer circumference of the rotor (2) is sealed off against the housing (1).

11. A method for treating milling products, wherein steam-containing milling products is conducted via a housing (1) to a pocket (8) in a rotor (2) rotating in the housing (1), the milling products being moved radially outwardly toward a circumference surface of the housing (1) by centrifugal force and from there thrown out through an outlet (12) for milling products when the outlet (12) communicates with the pocket (8), and wherein remaining steam thereafter is emptied radially inwardly when the pocket (8) is in communication with a steam outlet (15, 18) of the housing (1).

* * * * *